United States Patent [19]

Bergman et al.

[11] 4,220,011

[45] Sep. 2, 1980

[54] AIR COOLED CENTRIFUGAL REFRIGERATION SYSTEM WITH WATER HEAT RECOVERY

[75] Inventors: Mark O. Bergman, La Crosse; John W. Leary, Onalaska; Duane F. Sanborn; Chester D. Ware, both of La Crosse, all of Wis.

[73] Assignee: The Trane Company, La Crosse, Wis.

[21] Appl. No.: 972,309

[22] Filed: Dec. 22, 1978

[51] Int. Cl.[3] ..... F25B 27/02

[52] U.S. Cl. ..... 62/185; 62/196 B; 62/238

[58] Field of Search ..... 62/185, 238 E, 324 D, 62/196 B; 165/35

[56] References Cited

U.S. PATENT DOCUMENTS

| | | | |
|---|---|---|---|
| 2,787,128 | 4/1957 | Brown . | |
| 3,017,162 | 1/1962 | Haines et al. | 62/238 |
| 3,188,829 | 6/1965 | Siewert et al. | |
| 3,260,067 | 7/1966 | McClure et al. | |
| 3,628,600 | 12/1971 | McFarlan | 165/22 |
| 3,857,253 | 12/1974 | Burgett et al. | 62/289 |
| 4,081,971 | 4/1978 | Eber | 62/216 |

*Primary Examiner*—William E. Wayner

*Attorney, Agent, or Firm*—Carl M. Lewis; Peter D. Ferguson

[57] ABSTRACT

A refrigeration system is disclosed which includes evaporator means of the type for producing chilled liquid and wherein a compressor of the centrifugal type is provided for compressing refrigerant which has been vaporized in the evaporator means. Both air cooled and liquid cooled condenser means are connected in parallel flow relationship to the compressor, whereby the heat of condensation and compression may be rejected either to a source of ambient air or recovered through heat exchange with a source of liquid, whereby a heated liquid is produced for use as desired. Conduit means which are provided for passing condensed refrigerant from the air cooled and liquid cooled condenser means to the evaporator means include valve means for selectively varying the flow of condensed refrigerant from each, whereby the flow of condensed refrigerant from the air cooled condenser means may be reduced so as to cause at least partial flooding thereof and thereby reduce its capacity, while the flow of condensed refrigerant from said liquid cooled condenser means may be increased so as to increase the production of heated liquid. Control means are also disclosed for operating the aforesaid valve means in response to a sensed demand for heated liquid.

8 Claims, 1 Drawing Figure

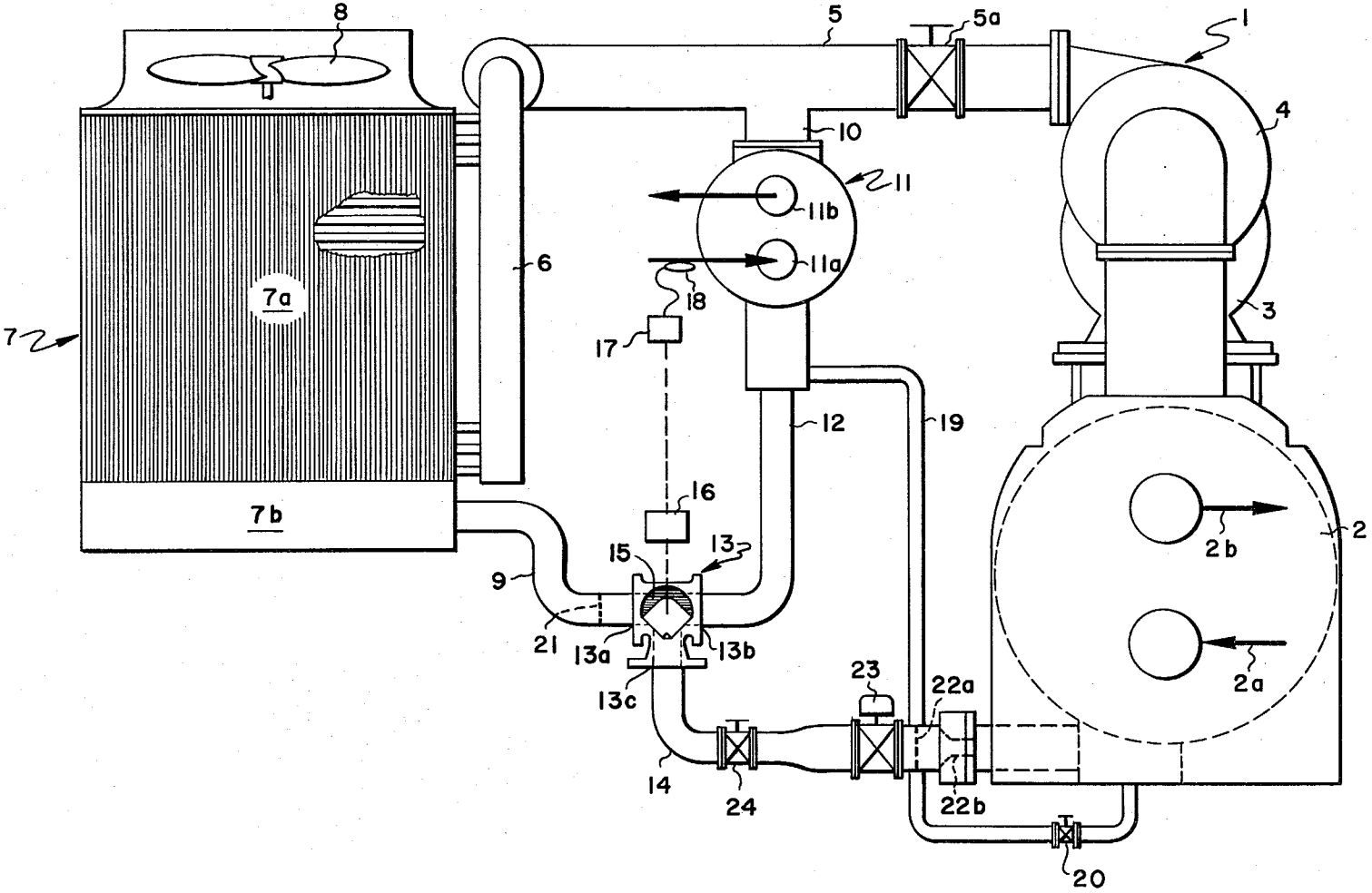
1
2
2a
2b
3
4
5
5a
6
7
7a
7b
8
9
10
11
11a
11b
12
13
13a
13b
13c
14
15
16
17
18
19
20
21
22a
22b
23
24

AIR COOLED CENTRIFUGAL REFRIGERATION SYSTEM WITH WATER HEAT RECOVERY

DESCRIPTION

1. Technical Field

The present invention relates generally to the field of refrigeration, and more specifically to refrigeration machines of relatively large cooling capacity employing centrifugal compressors which provide chilled liquid for use in applications such as building air conditioning.

2. Background Art

In the refrigeration and air conditioning industry today, most systems of relatively large cooling capacity, as would be required for the air conditioning system of a large office building, comprise centrifugal water chillers wherein a compressor of the centrifugal type is provided for compressing refrigerant which has been vaporized in order to produce a source of chilled liquid. Conventionally, refrigerant from the compressor is then passed to a water cooled condenser where it is condensed in heat exchange with a source of water to be returned to the evaporator. Commonly, the water used in the water cooled condenser is provided by a cooling tower of the evaporative type.

It has been recognized, however, that the heat of condensation and compression which is rejected in systems of the type described immediately above may be recovered in order to effect useful heating in a desired application. To this end, such systems have been provided with "double bundle" condensers wherein two separate liquid passages are provided through a common condenser, one stream for circulation to the cooling tower, the other for use in a heating application. An example of this type system is illustrated in U.S. Pat. No. 3,628,600.

A second, less common type large capacity refrigeration system includes a water chiller and centrifugal compressor as described above, but wherein an air cooled heat exchanger is provided as the condenser, whereby the heat of condensation and compression may be rejected directly to ambient air. Systems of this type, as disclosed in U.S. Pat. No. 3,857,253, possess certain advantages in that no cooling tower need be provided for its operation, thus permitting its use where water is scarce or where provision of a cooling tower is not practical for other reasons.

A drawback of such air cooled systems is that, due to the higher condensing pressures and temperatures generally encountered, the system operates at a lower efficiency than a comparable water cooled system. It would thus be desirable to recover for useful application at least a portion of the heat which is otherwise rejected to the ambient in an air cooled system of this type. The savings thus realized through the useful application of this heat will at least partially offset the less efficient operation of this type system. Insofar as applicants are aware, an air cooled centrifugal water chiller has never been provided which includes provision for recovering a portion or all of the heat of condensation and compression in order to produce a heated liquid for use as desired.

Disclosure of The Invention

The present invention includes evaporator means for vaporizing a condensed refrigerant by heat exchange with a source of liquid, whereby a chilled liquid is produced, and centrifugal compressor means connected to the evaporator means for receiving the thus-vaporized refrigerant and compressing same. Air cooled condenser means receive compressed refrigerant from the compressor means and condense same by heat exchange with a source of air, and liquid cooled condenser means connected in parallel flow relationship with the air cooled condenser means receive compressed refrigerant and condense same by heat exchange with a source of liquid, whereby a heated liquid is produced for use as desired. Conduit means for passing condensed refrigerant from the air cooled and liquid cooled condenser means to evaporator means include valve means for selectively varying the flow of condensed refrigerant from each of said condenser means, whereby the flow of condensed refrigerant from the air cooled condenser means may be reduced so as to cause at least partial flooding thereof and thereby reduce its capacity, while the flow of condensed refrigerant from the liquid cooled condenser means may be increased so as to increase the production of heated liquid.

Additionally, first means are provided for sensing the demand for heated liquid from the liquid cooled condenser means in conjunction with control means responsive thereto for operating the aforementioned valve means so as to decrease the flow of condensed refrigerant from the air cooled condenser means and increase the flow of condensed refrigerant from the liquid cooled condenser means in response to an increase in demand for heated liquid. In response to a decrease in said demand, the flow of condensed refrigerant from the air cooled condenser means is increased and the flow of condensed refrigerant from the liquid cooled condenser means decreased.

In a preferred embodiment, the valve means comprise a three-way valve having first and second inlet ports connected by respective first and second conduits to the respective air cooled and liquid cooled condenser means; and a common outlet port connected by third conduit means to the evaporator means.

Accordingly, it is an object of the present invention to provide a centrifugal water chiller of the type having air cooled condenser means for rejecting the heat of condensation and compression, which includes the further capability of recovering part or all of said heat in order to produce a heated liquid for useful heating applications as desired.

A further object of the invention relates to the provision of the air cooled and liquid cooled condenser means in parallel, as opposed to series, flow relationship in order to increase the heat recovery capacity of the system while reducing inefficiencies therein.

Another object of the present invention is to provide a system as described immediately above wherein the capacity of the air cooled condenser means may be controlled in a simple and reliable manner so as to make available the desired amount of refrigerant to be condensed for heat recovery purposes.

These and other objects of the present invention will become apparent hereinafter wherein the best mode for carrying out the invention is disclosed with reference to the appended drawings.

BRIEF DESCRIPTION OF THE DRAWING

The FIGURE is a schematic diagram of a refrigeration system constructed in accordance with the present invention.

BEST MODE FOR CARRYING OUT THE INVENTION

Turning now to the FIGURE, it will be seen that a refrigeration system indicated generally by the reference numeral 1 is provided which includes evaporator means 2 of the conventional water chiller (shell and tube) type wherein a liquid, such as water or a glycol solution is circulated through a tube bundle (not shown) in heat exchange with a liquid refrigerant. The refrigerant is vaporized by heat exchange with the liquid and leaves the evaporator means by way of conduit 3. Heat exchangers of this type are conventional in the art and no detailed description thereof is believed warranted; for the sake of clarity, however, a liquid inlet manifold is indicated generally by reference numeral **2*a* and an outlet manifold by reference numeral 2*b***.

Vaporized refrigerant from conduit 3 passes into a compressor of the centrifugal type as shown at 4. Centrifugal compressors per se are well-known in the refrigeration art, and, in the preferred embodiment, compressor 4 comprises a centrifugal compressor of the type driven by an electric motor through a gear train in order to increase the rotational speed of the compressor. In conjunction with this type compressor, the preferred refrigerant comprises R-12.

Compressed refrigerant leaves compressor 4 via conduit 5, passing through a normally open service valve **5*a*. Air cooled condenser means, indicated generally by reference numeral 7, are provided with an inlet manifold 6 which receives compressed refrigerant from conduit 5 and distributes same within main condenser portion 7*a* of air cooled condenser means 7. Refrigerant condensed in portion 7*a* then passes into a subcooler section 7*b* for further cooling before leaving air cooled condenser means 7 by way of first conduit 9. As shown, air cooled condenser means 7 includes fan means 8** for forcing air in heat exchange therewith in order to effect condensation of the refrigerant. Although only a single such fan is illustrated, it is to be understood that in a normal installation, a plurality of such fans would be provided, generally in conjunction with a condenser of generally elongated rectangular configuration, as disclosed in U.S. Pat. No. 3,857,253.

Connected in parallel flow relationship with air cooled condenser means 7 is a liquid cooled condenser means indicated generally at 11 which receives compressed refrigerant from conduit 5 by way of conduit 10. Liquid cooled condenser means 11 comprises a heat exchanger of the shell-and-tube type wherein a liquid, such as water or a glycol solution, passes through a tube bundle connected between an inlet manifold indicated generally by reference numeral **11*a*, and a discharge manifold indicated generally by reference numeral 11*b***. Compressed refrigerant passing over the exterior of said tubes is condensed by heat exchange with the liquid passing therethrough, to thereby produce a heated liquid. As will be appreciated by those skilled in the art, the temperature of such heated liquid may be in excess of 115° F. so as to be useful in a variety of heating applications.

Conduit means in the form of second conduit 12 are provided for passing condensed refrigerant from liquid cooled condenser means 11 to the second inlet port **13*b* of a three-way valve indicated generally by reference numeral 13. As previously discussed, condensed refrigerant from air cooled condenser means 7 passes via conduit means including first conduit 9 to the first inlet port 13*a*** of the three-way valve.

Outlet port **13*c* of the three-way valve is connected by third conduit means 14 to return condensed refrigerant to evaporator means 2**, thereby completing the refrigerant circuit.

As illustrated in the FIGURE, three-way valve 13 is a ball-type valve having a selectively positionable valve member 15 which may be rotated so as to vary the flow of condensed refrigerant through both first inlet port **13*a* and second inlet port 13*b*. As shown in the FIGURE, valve member 15 is in an intermediate position allowing a substantially equal amount of refrigerant flow through both inlet ports. By rotating the valve member 45 degrees in the clockwise direction (as seen in the FIGURE), first inlet port 13*a* will be placed in a full open position while second inlet port 13*b* will be completely closed off. Similarly, upon rotation of valve member 15 45 degrees in the counterclockwise direction, second inlet port 13*b* will be placed in a full open position and first inlet port 13*a* completely closed off. It should thus be apparent that valve means 13 are operable to permit 100% of the condensing load to be filled by either of air cooled condenser means 7 or liquid cooled condenser means 11**.

It is to be specifically noted that, as first inlet port **13*a* is selectively closed off, liquid refrigerant will accumulate in an air cooled condenser means 7, resulting in a condition commonly referred to as "flooding" of the condenser means. In this condition, the capacity of the air cooled condenser means is reduced when its tubes are filled with liquid refrigerant so as to prevent further condensation from taking place therein. With the capacity of air cooled condenser means 7 thus reduced, a greater portion of the condensing load may take place in liquid cooled condenser means 11** so as to increase the production of heated liquid.

Automatic controls are provided to operate valve means 13 and comprise first means for sensing the demand for heated liquid from liquid cooled condenser means 11 in the form of a temperature sensor 18 positioned so as to sense the temperature of liquid to be heated entering liquid cooled condenser means 11. Thus, a decrease in said entering temperature indicates an increase in demand for heated liquid, while an increase in the entering temperature indicates a decrease in such demand. Control means 17 are responsive to the temperature sensed by first means 18 and include a valve actuator 16 for selectively positioning valve member 15 in response to the desired or required demand for heated liquid from liquid cooled condenser means 11. In a preferred embodiment, first means 18, control means 17, and actuator means 16 would consist of a combination thermostat and oil submerged proportional control actuator equivalent to that manufactured by the Barber-Coleman Company, Catalog MU-48103.

It may be further noted at this time that conduit means 19 are provided connecting a lower sump portion of liquid cooled condenser means 11 to a lower sump portion of evaporator means 2, which conduit means also include a manually operable shutoff valve 20. The function of conduit means 19 and shutoff valve 20 are simply to provide for selective drainage of any liquid refrigerant which may accumulate in liquid cooled condenser means 11 during those times that little or no demand for heated liquid exists.

As shown in the FIGURE, first conduit 9 connecting subcooler portion **7*b* of air cooled condenser means 7 to the first inlet port of valve 13 includes first expansion means 21 for reducing the pressure of condensed refrigerant passing therethrough. In the preferred embodiment, first expansion means 21 comprise a fixed orifice plate having a plurality of perforations for the passage of liquid refrigerant. First expansion means 21 are necessary in the preferred embodiment due to the presence of subcooler 7*b* which provides refrigerant having a temperature below that corresponding to its saturation pressure, while liquid cooled condenser means 11** includes no provision for subcooling.

This scheme has been found to operate successfully under conditions of both 100% heat recovery or 100% air cooled condensing, in conjunction with fixed orifice plates **22*a*, *b*** described below.

It should be pointed out that, while three-way valve 13 does present a slight pressure drop to refrigerant flow therethrough, this drop is relatively small compared to that provided by orifice plate 21. For example, at 100% air cooled condensing, the pressure drop across orifice plate 21 would be on the order of 10–20 psi while that across valve 13 would be around 2 psi.

In order to reduce the pressure of condensed refrigerant admitted to evaporator means 2, third conduit means 14 are provided with second expansion means in the form of fixed orifice plates **22*a* and 22*b***, the former having a plurality of perforations therethrough for the passage of condensed refrigerant and the latter comprising a converging flow passage. Reference may be had to U.S. Pat. No. 3,260,067 for further information relative to this type expansion means.

Third conduit means 14 also include an automatically controlled shutoff valve 23, as fully disclosed in U.S. Pat. No. 4,081,971, so as to prevent possible freeze-up of evaporator means 2 during those times that the refrigeration system is shut down and air cooled condenser means 7 is exposed to low ambient temperature conditions. Reference may also be had to commonly assigned, copending U.S. Patent Application Ser. No. 972,310, filed Dec. 22, 1978, in the names of John W. Leary, Mark O. Bergman, and John L. Honeck wherein alternative freeze prevention means are disclosed in the form of an inverted U-tube between the condenser and evaporator for blocking refrigerant flow during shut down.

In order to facilitate servicing of the machine, normally open manually operated shutoff valves **5*a* and 24 are provided in respective conduits 5 and 14**.

While it is believed that operation of the refrigeration system has been made apparent from the description above, such operation will be summarized at this time. During those times when there is no demand for heated liquid from liquid cooled condenser means 11, substantially all the refrigerant compressed by centrifugal compressor means 4 will pass via conduit 5 to air cooled condenser means 7 for condensation, passing therefrom via first conduit 9, through first expansion means 21, three-way valve 13, third conduit means 14, and into evaporator means 2 through second expansion means **22*a*, 22*b*. Should a demand for heated liquid arise, as sensed by first means 18, control means 17 will cause actuator 16 to rotate valve member 15 in a counterclockwise direction (as viewed in the FIGURE) so as to at least partially open second inlet port 13*b* and thereby permit the flow of liquid refrigerant from liquid cooled condenser means 11 therethrough. Simultaneously, first inlet port 13*a* will be partially closed off to the flow of liquid refrigerant from air cooled condenser means 7, resulting in the flooding and concomitant capacity reduction therein as described above, thus increasing the amount of compressed refrigerant available for condensation in liquid cooled condenser means 11 in order to satisfy the sensed demand for heated liquid. Upon a decrease in such demand, the reverse would occur, shifting the condensing load back to air cooled condenser means 7**.

It will be appreciated that three-way valve 13 is operative to maintain stable flow conditions from the air cooled and liquid cooled condenser means over an operating range from 100% air cooled condensing to 100% heat recovery operation. This is accomplished through a constant balancing process, whereby changes in pressure within the air cooled condenser, as result from its being flooded to varying degrees, are compensated for by adjustments of the position of valve member 15 in response to control means 17, thereby maintaining the desired production of heated liquid.

In the preferred embodiment, both air cooled condenser means 7 and liquid cooled condenser means 11 are provided with sufficient condensing capacity so as to handle the entire condensing load when centrifugal compressor means 4 is operated at its full capacity.

Moreover, it should be specifically pointed out that, since the air cooled and liquid cooled (heat recovery) condensers are in parallel, as opposed to series, flow relationship, substantially 100% of the condensing load is available for heat recovery. If the condensers were in series flow relationship, the air cooled condenser, being exposed to the ambient, would absorb from 15 to 35% of the available load. Further, the additional pressure drop through the air cooled condenser would represent an unwanted and unnecessary inefficiency within the system.

It should be further pointed out that, while a three-way valve is the preferred form of valve means 13, it is within the scope of the invention that two two-way valves could be provided, one disposed in first conduit 9 and the other disposed in second conduit 12, provided with the appropriate control scheme for simultaneously and inversely varying the condensed refrigerant flow capacity of each.

As a matter of interest, it should be noted that evaporator means 2 is provided with sufficient liquid refrigerant storage capacity in order to provide that amount necessary to flood air cooled condenser means 7 during full heat recovery operation; e.g., when liquid cooled condenser means 11 is satisfying the entire condensing load for the system. This results in an added operating feature of the system in that, during operation under low ambient conditions, this refrigerant is available to flood the air cooled condenser, whether or not heat recovery is required, thereby maintaining adequate pressure therein to insure proper refrigerant flow to the evaporator.

While the invention has been described with respect to a preferred embodiment, it is to be understood that modifications thereto will be apparent to those skilled in the art within the scope of the invention, as defined in the claims which follow.

We claim:

1. A refrigeration system for producing a chilled liquid and selectively operable to produce a heated liquid, said system comprising a. evaporator means for vaporizing a condensed refrigerant by heat exchange with a source of liquid, whereby a chilled liquid is produced;

b. centrifugal compressor means connected to said evaporator means for receiving vaporized refrigerant and compressing same;

c. air cooled condenser means connected to said centrifugal compressor means for receiving compressed refrigerant and condensing same by heat exchange with a source of air;

d. liquid cooled condenser means connected to said centrifugal compressor means in parallel flow relationship with said air cooled condenser means for receiving compressed refrigerant and condensing same by heat exchange with a source of liquid, whereby a heated liquid is produced;

e. a first conduit connected to an outlet of said air cooled condenser means;

f. a second conduit connected to an outlet of said liquid cooled condenser means;

g. valve means connected to said first and second conduits for selectively varying the flow of condensed refrigerant from each of said condenser means, whereby the flow of condensed refrigerant from said air cooled condenser means may be reduced so as to cause at least partial flooding thereof and thereby reduce its capacity, while the flow of condensed refrigerant from said liquid cooled condenser means may be increased so as to increase the production of heated liquid; and h. third conduit means connecting said valve means to said evaporator means.

2. The refrigerant system of claim 1 further comprising a. first means for sensing the demand for heated liquid from said liquid cooled condenser means; and b. control means responsive to said first means for operating said valve means so as to i. decrease the flow of condensed refrigerant from said air cooled condenser means and increase the flow of condensed refrigerant from said liquid cooled condenser means in response to an increase in demand for heated liquid; and ii. increase the flow of condensed refrigerant from said air cooled condenser means and decrease the flow of condensed refrigerant from said liquid cooled condenser means in response to a decrease in demand for heated liquid.

3. The system of claim 2 wherein said first means comprise means for sensing the temperature of liquid entering said liquid cooled condenser means, a decrease in said temperature indicating an increase in demand for heated liquid, an increase in said temperature indicating a decrease in demand for heated liquid.

4. The system of claims 1, 2, or 3 wherein said valve means comprise a three-way valve having first and second inlet ports and an outlet port, and a selectively positionable valve member for varying flow between said inlet ports and said outlet port; and wherein said first conduit is connected to said first inlet port, said second conduit is connected to said second inlet port, and said third conduit means is connected to said outlet port.

5. The system of claims 1, 2, or 3 wherein said first conduit includes first expansion means for reducing the pressure of condensed refrigerant passing therethrough and said third conduit means includes second expansion means for reducing the pressure of condensed refrigerant passing therethrough.

6. The system of claim 5 wherein said first and second expansion means comprise orifice plates having a plurality of perforations for the passage of liquid refrigerant.

7. The system of claims 1, 2, or 3 wherein said valve means are operative to partially close off the flow of condensed refrigerant through said first conduit so as to effect partial flooding and capacity reduction of said air cooled condenser means, while partially opening the flow of condensed refrigerant through said second conduit so as to increase the condensation of refrigerant in said liquid cooled condenser means and the production of heated liquid thereby.

8. The system of claim 7 wherein said valve means are operative to control the flow of condensed refrigerant from said air cooled and liquid cooled condenser means over an operating range from 100% air cooled condensing to 100% liquid cooled condensing.

* * * * *